US010011939B2

(12) United States Patent
Park

(10) Patent No.: US 10,011,939 B2
(45) Date of Patent: Jul. 3, 2018

(54) PARTITIONING APPARATUS FOR WASHER/DRYER COMBINATION

(71) Applicant: Ki Kwon Park, Brooklyn, NY (US)

(72) Inventor: Ki Kwon Park, Brooklyn, NY (US)

( * ) Notice: Subject to any disclaimer, the term of this patent is extended or adjusted under 35 U.S.C. 154(b) by 356 days.

(21) Appl. No.: 14/841,162

(22) Filed: Aug. 31, 2015

(65) Prior Publication Data

US 2017/0058445 A1 Mar. 2, 2017

(51) Int. Cl.
*D06F 37/26* (2006.01)
*D06F 37/08* (2006.01)
*D06F 58/04* (2006.01)

(52) U.S. Cl.
CPC ..... *D06F 37/267* (2013.01); *D06F 37/08* (2013.01); *D06F 58/04* (2013.01)

(58) Field of Classification Search
CPC ..... D06F 37/08; D06F 37/16; D06F 58/04; Y10T 403/69; Y10T 403/64; Y10T 403/642; Y10T 403/648
USPC ..... 34/108, 109, 600, 602, 603; 403/344, 403/335, 336, 338
See application file for complete search history.

(56) References Cited

U.S. PATENT DOCUMENTS 2,400,726 A * 5/1946 Wright ..... D06B 3/10 118/429
2,816,742 A * 12/1957 Richterkessing ..... D06F 58/04 34/130
3,637,224 A * 1/1972 Triplett ..... D06F 58/04 277/399
6,945,620 B2 * 9/2005 Lam ..... A47B 88/493 312/334.12
2012/0011735 A1 * 1/2012 Hong ..... D06F 58/04 34/108
2012/0291497 A1 * 11/2012 Scarafiotti ..... D06F 37/08 68/139
2014/0202218 A1 * 7/2014 Hong ..... D06F 58/08 68/140
2016/0047599 A1 * 2/2016 Jacob ..... B01J 8/38 34/357

FOREIGN PATENT DOCUMENTS

FR 2291309 A1 * 6/1976 ..... D06F 37/10

OTHER PUBLICATIONS

FR2291309; retrieved electronically on Jun. 16, 2017.*

* cited by examiner

*Primary Examiner* — Kenneth Rinehart
*Assistant Examiner* — Logan Jones
(74) *Attorney, Agent, or Firm* — Heedong Chae; Lucem, PC

(57) ABSTRACT

A partitioning apparatus for a washer/dryer combination includes a plurality of arch sections, a plurality of longitudinal couplers, a plurality of flanges attached to or formed on each of the plurality of longitudinal couplers, and a locking means for affixing the plurality of longitudinal couplers to a drum of the washer/dryer combination. The plurality of arch sections form a cylindrical body and the partitioning apparatus divides the drum of the washer/dryer combination into a cylindrical space and a plurality of arch spaces.

16 Claims, 6 Drawing Sheets

PARTITIONING APPARATUS FOR WASHER/DRYER COMBINATION

FIELD OF THE INVENTION

The present invention relates to a partitioning apparatus for a washer/dryer combination. More particularly, this invention relates to a partitioning apparatus for a washer/dryer combination having a cylindrical body and flanges to divide a dram of the combination into spaces each of which is sized to receive garments for washing and/or drying.

BACKGROUND OF THE INVENTION

There are two types of cleanings: wet cleaning and dry-cleaning. Wet cleaning uses a gentle washing machine, biodegradable soaps and conditioners, and pressing and re-shaping equipment that may be specialized for many different fabric and fiber types. Wet cleaning is generally environmentally friendly, but delicate fabrics such as wool, silk, linen, rayon, leather, dry only fabric, or the like cannot withstand the rough and tumble of a washing machine and clothes dryer. Thus, dry cleaning is used for such delicate fabrics.

Dry cleaning has the advantage of eliminating labor-intensive hand washing and uses a chemical solvent such as tetrachloroethylene (perchloroethylene) because perchloroethylene has excellent cleaning power and is stable, non-flammable, and gentle to most garments.

However, perchloroethylene is a toxic carcinogenic substance and dry cleaning generates other hazardous wastes such as sludge, cooked muck, filters, chemical solvents, etc.

Therefore, wet cleaning is preferable to dry cleaning, but delicate fabrics are not suitable for wet cleaning because they can be damaged or fabric deformation or shrinkage may occur during wet cleaning. Delicate fabrics may be damaged or deformed while getting rotated, fell, twisted, or tangled in a washing/drying machine.

Accordingly, to solve the above problems, a need for a partitioning apparatus for a washer/dryer combination to be used to wash and dry delicate fabrics has been present for a long time considering the expansive demands in the everyday life. This invention is directed to solve these problems and satisfy the long-felt need.

SUMMARY OF THE INVENTION

The present invention contrives to solve the disadvantages of the prior art. The present invention relates to a partitioning apparatus for a washer/dryer combination, a washer or a dryer. More particularly, this invent ion relates to a partitioning apparatus for a washer/dryer combination (or a washer or a dryer) having a cylindrical body and flanges to divide a drum of the combination into spaces each of which is sized to receive garments for washing and/or drying.

An object of the invention is to provide a partitioning apparatus for a washer/dryer combination, having a plurality of arch sections, a plurality of longitudinal couplers, a plurality of flanges attached to or formed on each of the plurality of longitudinal couplers, and a locking means for affixing the plurality of longitudinal couplers to a drum of the washer/dryer combination. The plurality of arch sections form a cylindrical body and the partitioning apparatus divides the drum of the washer/dryer combination into a cylindrical space and a plurality of arch spaces.

Another object of the invention is to provide a partitioning apparatus for a washer/dryer combination, having a plurality of arch sections, a plurality of longitudinal couplers, a plurality of flanges attached to or formed on each of the plurality of longitudinal couplers, and a locking means for affixing the plurality of longitudinal couplers to a drum of the washer/dryer combination. Two sliders are respectively attached to the two side ends of the arch section and each slider is configured to be coupled to a rail of the coupler. Each arch section slides backward and forward with respect to the longitudinal couplers.

Still another object of the invention is to provide a partitioning apparatus for a washer/dryer combination, having a cylindrical body, a plurality of flanges, and a locking means for securing the partitioning apparatus to a drum of the washer/dryer combination. The cylindrical body and the flanges divide the drum into a cylindrical space and a plurality of arch spaces so that each space is sized to receive garments for washing or drying.

Still another object of the invention is to provide a partitioning apparatus for a washer or a dryer, having a cylindrical body, a plurality of flanges, and a locking means. The cylindrical body and the flanges divide the drum into a cylindrical space and a plurality of arch spaces so that each space is sized to receive garments for washing or drying.

The advantages of the present invention are: (1) using the present invention, delicate fabrics such as wool, silk, linen, rayon, leather, dry only fabric, or the like can be washed and dried by a washer/dryer combination without being damaged, deformed, twisted or tangled; (2) the present invention dispenses with the need for dry cleaning or hand washing for delicate fabrics; (3) the present invention is easy to install and use; (4) the present invention can be installed into a drum of a washer/dryer combination, a washer or a dryer; (5) the present invention is environmentally friendly; (6) arch spaces formed by the present invention are suitable for washing and drying delicate fabrics and the delicate fabrics are less vulnerable to damages or deformation because the arch space keeps delicate fabrics from falling, twisting, entanglement or other mechanical abrasion in a drum; and (7) cost of cleaning delicate fabrics can be saved by using the present invention.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
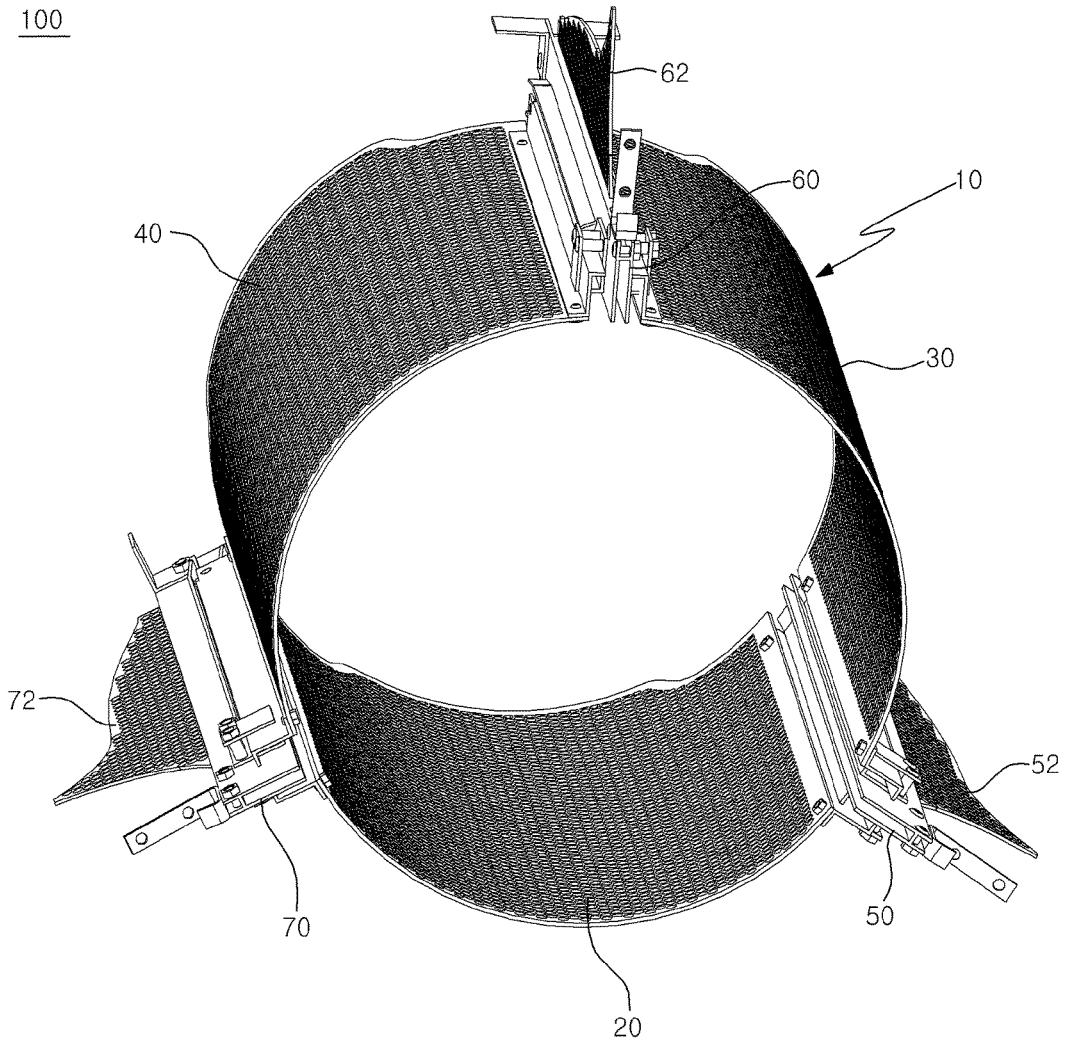
FIG. 1 is a perspective view of a partitioning apparatus for a washer/dryer combination, a washer, or a dryer according to the present invention.
Figure 2:
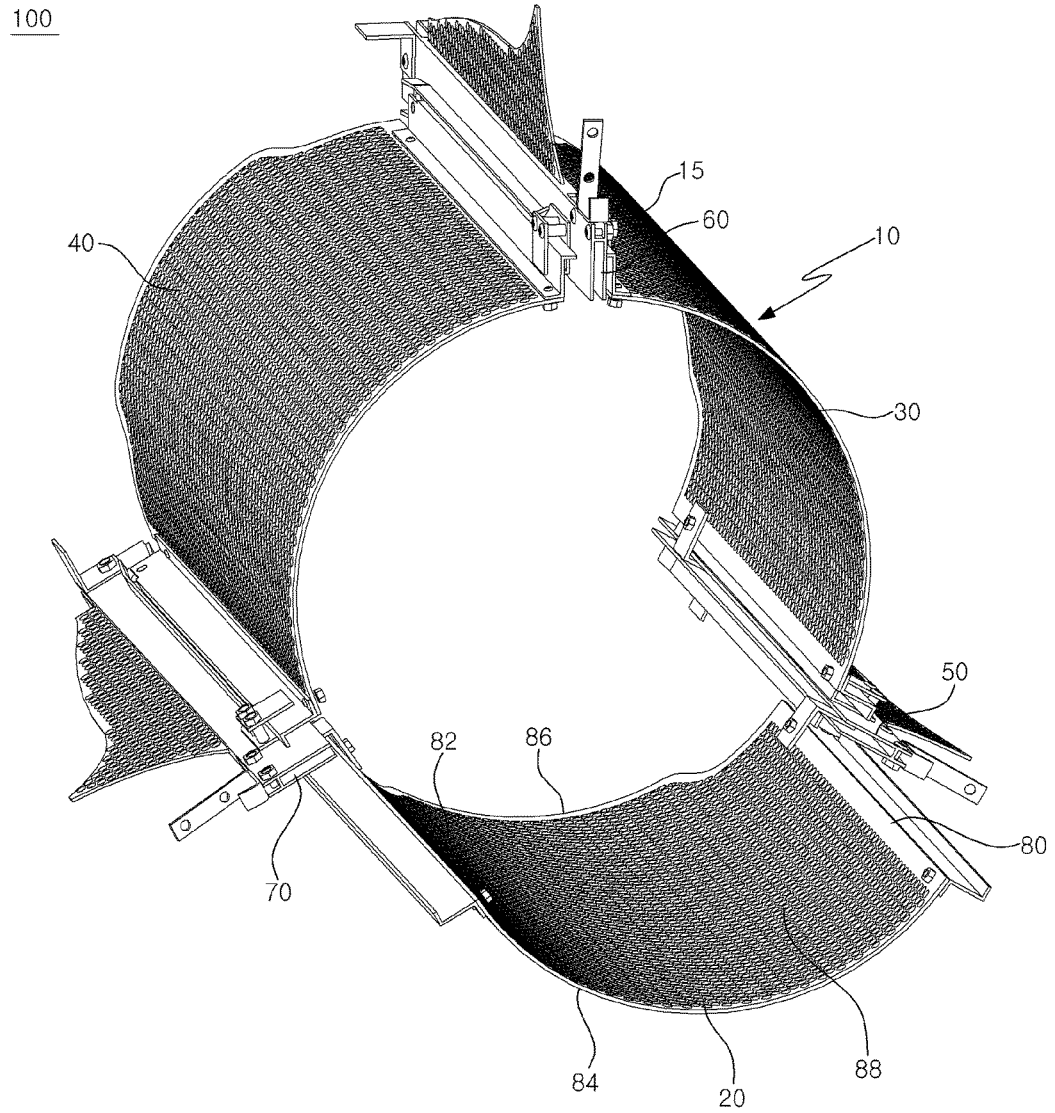
FIG. 2 is another perspective view of the partitioning apparatus with an arch section slid open.
Figure 3:
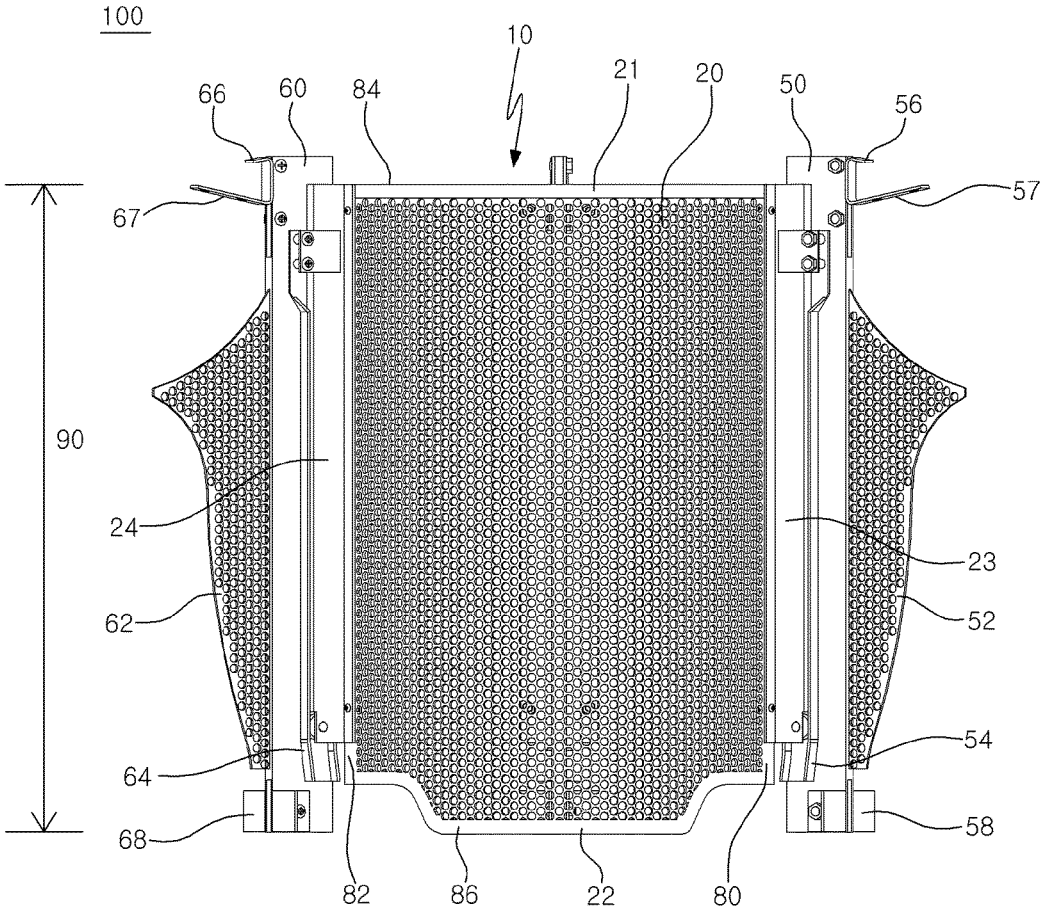
FIG. 3 is a front view of the partitioning apparatus according to the present invention.

FIG. 1 is a perspective view of a partitioning apparatus 100 for a washer/dryer combination, a washer, or a dryer 200 according to the present invention. FIG. 2 is another perspective view of the partitioning apparatus 100 with an arch section 20, 30 or 40 slid open and FIG. 3 is a front view of the partitioning apparatus 100.

The partitioning apparatus 100 for a washer/dryer combination 200 includes a plurality of arch sections 20, 30 and 40, a plurality of longitudinal couplers 50, 60, and 70, a plurality of flanges 52, 62, and 72, and a locking means 56, 57, 58, 66, 67, 68, 77, 78, and 79 (66, 67, 68, 77, 78, and 79 not indicated in the figures, but respectively corresponding to 56, 57, and 58). Each arch section 20, 30 or 40 has top and bottom curved ends and two side ends such that top and bottom rim members 21 and 22 (31 and 32 for 30, and 41 and 42 for 40, not indicated in the figures) are respectively attached to the top and bottom ends and two sliders 23 and 24 (33, 34 for 30, and 43, 44 for 40, not indicated in the figures) are respectively attached to the two side ends.

Each coupler 50, 60, or 70 has rails 54, 64 and 74 on both side of each longitudinal couplers 50, 60, and 70. A slider 23 (or 24) is configured to foe coupled to a rail 54 (or 64) so that the slider 23 and the rail 54 can slide against each other and each arch section 20 slides backward and forward with respect to the longitudinal couplers 50 and 60. In the same way, arch sections 30 and 40 have sliders 33, 34, 43, and 44 (not indicated in the figures) slidable along the rails of the couplers 50, 60, and 70.

Each flange 52, 62 or 72 is attached to or formed on each of the plurality of longitudinal couplers 50, 60, and 70. In addition, the locking means 56, 57, 58, 66, 67, 68, 77, 78, and 79 affixes the plurality of longitudinal couplers to a drum of the washer/dryer combination so that the partitioning apparatus 100 can be fixed to the drum. Any locking means known in the art may be used as long as the locking means can securely affix the partitioning apparatus 100 to the drum.

Figure 6:
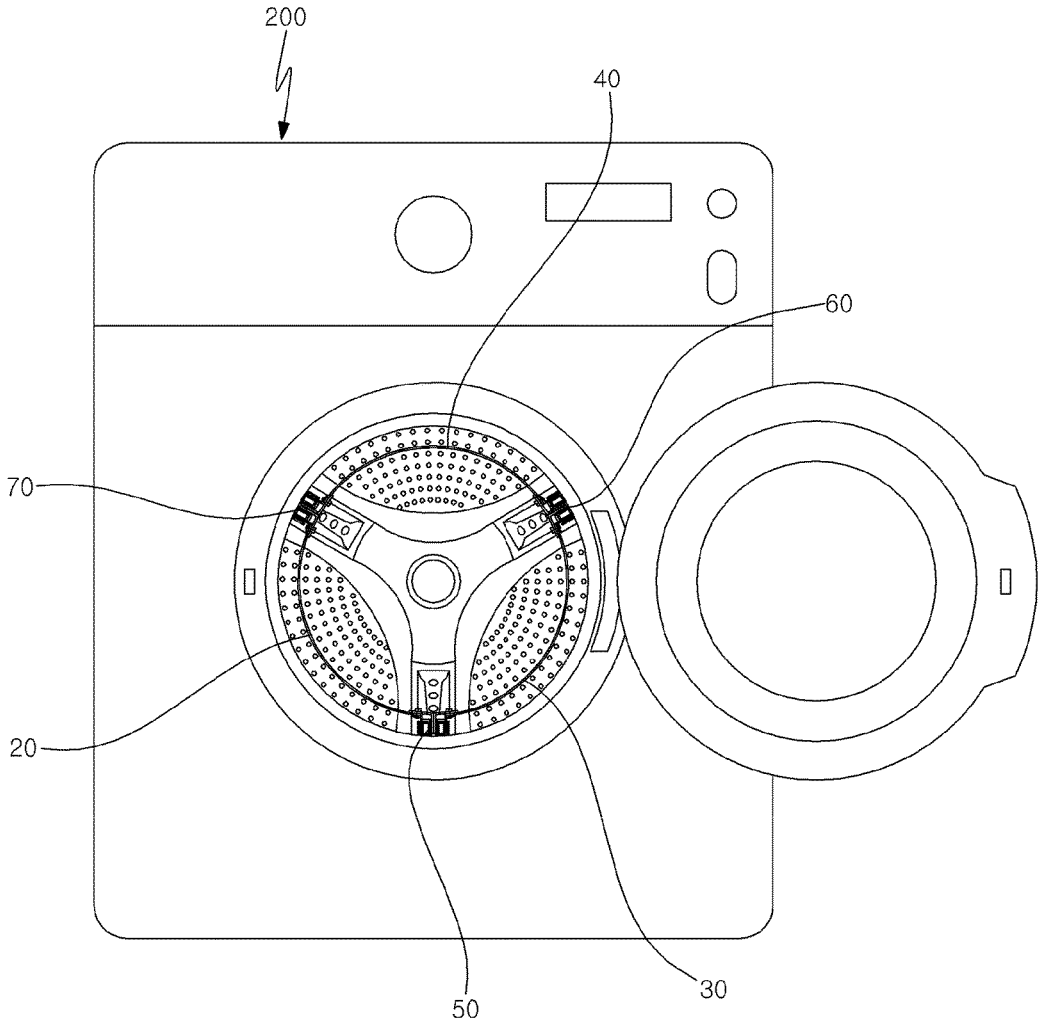
FIG. 6 is a front view of a washer/dryer combination, a washer, or a dryer with the partitioning apparatus installed therein.

The plurality of arch sections 20, 30 and 40 may form a cylindrical body 10 such that the partitioning apparatus 100 divides the drum of the washer/dryer combination 200 into a cylindrical space and a plurality of arch spaces. The cylindrical space is a space formed by the cylindrical body 10 and the arch spaces are spaces around the cylindrical space. The number of the arch spaces is the same as that of flanges and the example of FIG. 6 shows three arch spaces.

The flanges 52, 62, and 72 are configured to fit snugly within the drum of the washer/dryer combination 200. The flanges 52, 62, and 72 are preferably located in contact with baffles 220 of the drum and thus, the flanges 52, 62, and 72 are preferably constructed to correspond to a shape of a baffle 220 of the drum of the washer/dryer combination 200.

The partitioning apparatus 100 may further comprise a sliding lock and a sliding stopper (not shown) for each couple of the slider and the rail so that the sliding lock locks the slider to the rail for preventing sliding and the sliding stopper stops the slider against the rail for preventing further sliding. Once the partitioning apparatus 100 of the present invention is installed on a drum of a washer/dryer combination, a user may slide open an arch section 20, 30, or 40 and place garments into an arch space for washing or drying. After garments are placed in an arch space, the arch section 20, 30, or 40 needs to be locked by the sliding look to prevent it from opening during operation of the washer/dryer combination 200. In addition, the sliding should stop at certain point by the sliding stopper to prevent the arch section 20, 30, or 40 from slipping out of rails of the couplers 50, 60 and 70. Such sliding lock and sliding stopper are well known in the art and any sliding lock or sliding stopper may be used as long as they are suitable for the functions above.

A plurality of holes are formed on the arch sections 20, 30 and 40 and the flanges 52, 62, and 73 so that water or air can flow through the holes.

The number of arch sections, couplers, or flanges can be any number such as 3, 4, 5 or 6 as long as the partitioning apparatus 100 is effective in washing or drying delicate fabrics, but preferably, there are three arch sections, three couplers, and three flanges.

The locking means may comprise a plurality of clamps 56, 66, and 76 and hooks 57, 67, and 77 such that each clamp and hook 56 and 57 (66 and 67, or 76 and 77) are attached to the coupler so that the clamp is clamped to a side 230 of the drum of the washer/dryer combination 200 and the hook is hooked to a top of the drum of the washer/dryer combination 200.

The bottom curved end and the bottom rim member 22 (32 and 42 not indicated in the figures) are configured to correspond to a shape of a bottom 240 of the drum of the washer/dryer combination 200 and the bottom rim member is coated with silicon for tight contact with the bottom 240 of the drum, of the washer/dryer combination 200.

The arch sections 20, 30 and 40 may be preferably made of aluminum.

Figure 4:
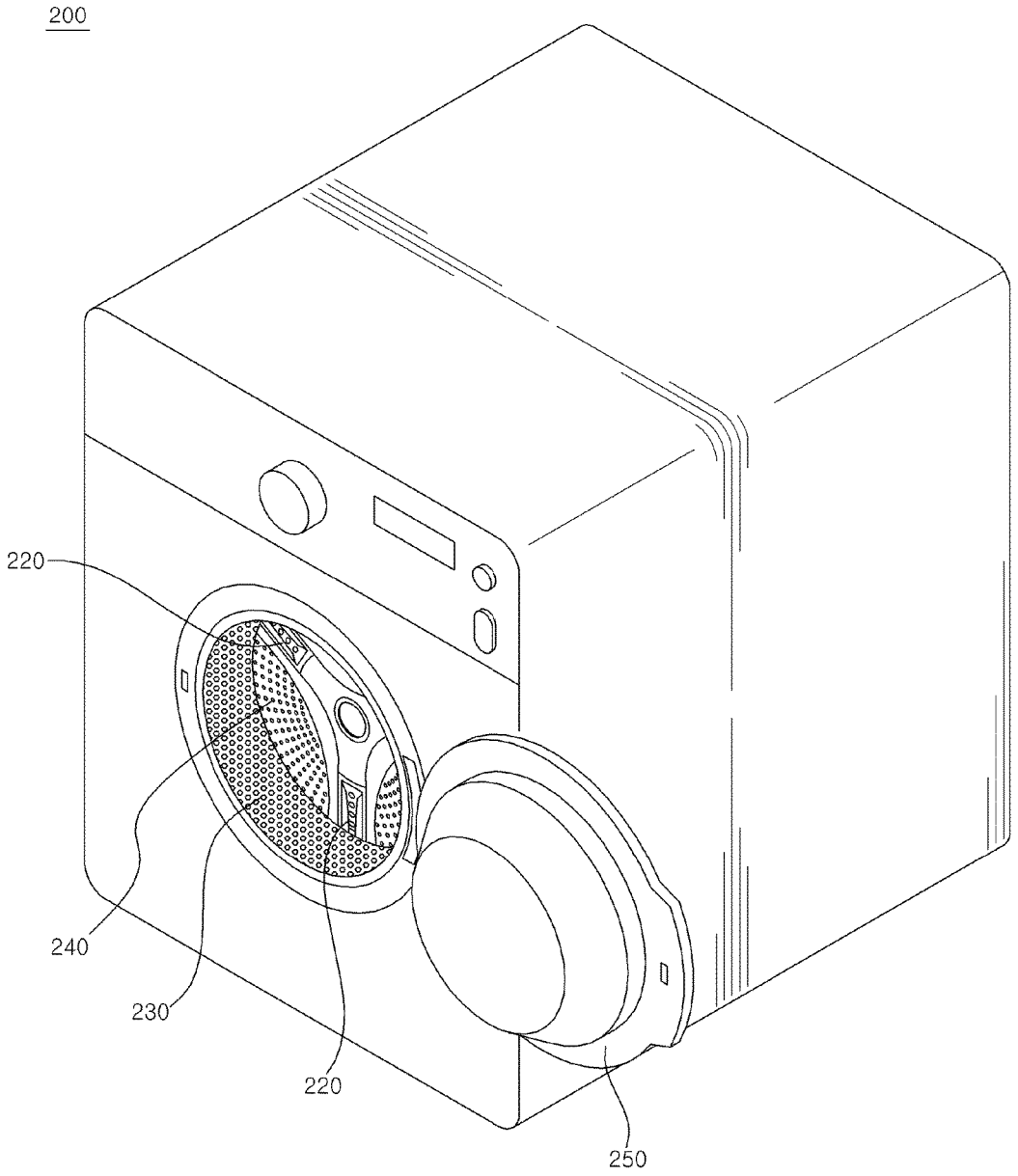
FIG. 4 is a perspective view of a washer/dryer combination, a washer, or a dryer.
Figure 5:
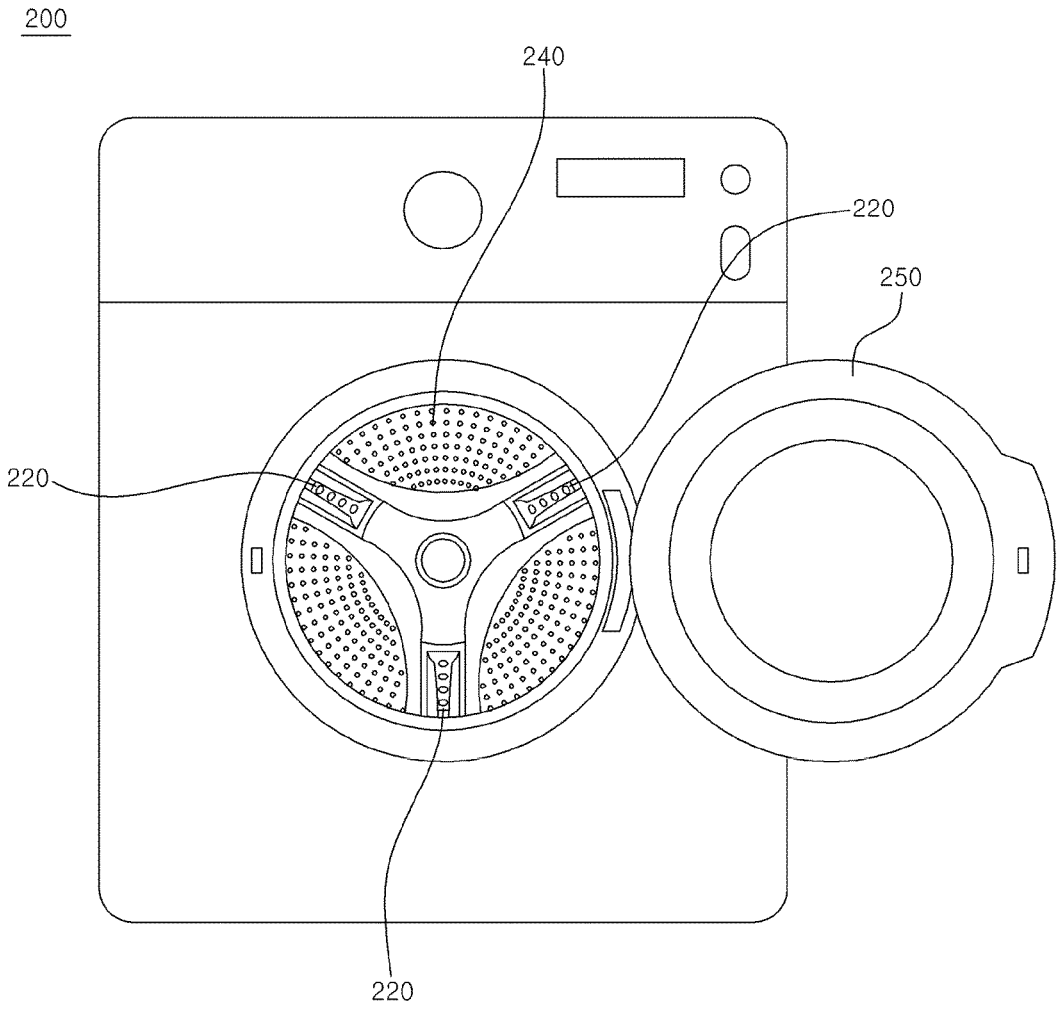
FIG. 5 is a front view of a washer/dryer combination, a washer, or a dryer.

FIGS. 4 and 5 are respectively perspective and front views of a washer/dryer combination, a washer, or a dryer 200. FIG. 6 is a front view of a washer/dryer combination, a washer, or a dryer 200 with the partitioning apparatus 100 installed therein.

In the alternative embodiment, the partitioning apparatus 100 for a washer/dryer combination 200 includes a cylindrical body 10 having an open top end and an open bottom end; a plurality of flanges attached to an outer side of the body 10 along a direction of a height of the body 10; and a locking means for securing the partitioning apparatus 100 to a drum of the washer/dryer combination 200. The flanges are configured to fit snugly within the drum of the washer/dryer combination 200. In addition, the cylindrical body 10 and the flanges divide the drum into a cylindrical space and a plurality of arch spaces so that each space is sized to receive garments for washing or drying. Preferably, delicate fabrics are received in the arch spaces so that they are less exposed to friction with the drum or impact from falling, or getting twisted or tangled together.

A plurality of holes are formed on the cylindrical body 10 and the flanges.

The flange is preferably constructed to correspond to a shape of a baffle 240 of the drum of the washer/dryer combination 200.

The number of flanges can be any number such as 3, 4, 5 or 6 as long as the partitioning apparatus 100 is effective in washing or drying delicate fabrics, but preferably, there are three flanges and thus three arch spaces.

Top and bottom rim members are respectively attached to the open top and bottom ends of the body 10. The open bottom end and the bottom rim member are configured to correspond to a shape of a bottom 240 of the drum of the washer/dryer combination 200 and the bottom rim member is coated with silicon for tight contact with the bottom 240 of the drum of the washer/dryer combination 200.

The locking means may comprise a plurality of clamps and hooks wherein each clamp is constructed to be clamped to a side 230 of the drum of the washer/dryer combination 200 and each hook is constructed to be hooked to a top of the drum of the washer/dryer combination 200.

The cylindrical body 10 is constructed to be fixedly secured to a bottom 240 of the drum of the washer/dryer combination. Preferably, the cylindrical body 10 is made of aluminum.

FIG. 6 is a front view of a washer/dryer combination, a washer, or a dryer 200 with the partitioning apparatus 100 installed therein. In one example of the present invention, the diameter of the cylindrical body 10 is about 12 inches and the diameter of the drum is about 22 inches. The opening to be closed by the door 250 has about 16 inches in diameter. Accordingly, the opening gap for an arch space has only about 2 inches in length, and it is not suitable to insert garments through the opening gap. Thus, the sliding open feature of the arch section 20, 30 or 40 is very useful to place garments into the arch space.

Still in another embodiment of the present invention, a partitioning apparatus 100 for a washer or a dryer 200 includes a cylindrical body 10 having an open top end and an open bottom end; a plurality of flanges attached to an outer side of the body 10 along a direction of a height of the body 10; and a locking means for securing the partitioning apparatus 100 to a drum of the washer or the dryer 200. The flanges are configured to fit snugly within the drum of the washer or the dryer. In addition, the cylindrical body 10 and the flanges divide the drum into a cylindrical space and a plurality of arch spaces so that each space is sized to receive garments for washing or drying.

There are three flanges and a plurality of holes are formed on the cylindrical body and the flanges.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A partitioning apparatus for a washer/dryer combination, comprising:

a plurality of arch sections having top and bottom curved ends and two side ends wherein top and bottom rim members are respectively attached to the top and bottom ends and two sliders are respectively attached to the two side ends;

a plurality of longitudinal couplers having rails on both sides of each longitudinal couplers wherein each slider is configured to be coupled to a respective rail so that each slider can slide against the respective rail and each arch section slides backward and forward with respect to the longitudinal couplers;

a plurality of flanges each of which is attached to or formed on each of the plurality of longitudinal couplers wherein each flange extends longitudinally along and outwardly from the respective longitudinal coupler; and a locking means for affixing the plurality of longitudinal couplers to a drum of the washer/dryer combination, wherein the locking means comprises a plurality of clamps and hooks wherein each clamp and hook are attached to a respective one of the plurality of longitudinal couplers so that a clamp is clamped to a side of the drum of the washer/dryer combination and each hook is hooked to a top of the drum of the washer/dryer combination, wherein the plurality of arch sections form a cylindrical body;

wherein the partitioning apparatus is configured to divides the drum of the washer/dryer combination into a cylindrical space and a plurality of arch spaces, and each flange separates the arch spaces from each other.

2. The partitioning apparatus of claim 1, wherein the flange is constructed to correspond to a shape of a baffle of the drum of the washer/dryer combination.

3. The partitioning apparatus of claim 1, wherein a plurality of holes are formed on the arch sections and the flanges.

4. The partitioning apparatus of claim 1, wherein there are three arch sections, three couplers, and three flanges.

5. The partitioning apparatus of claim 1, wherein the bottom curved end and the bottom rim member are configured to correspond to a shape of a bottom of the drum of the washer/dryer combination and the bottom rim member is coated with silicon for tight contact with the bottom of the drum of the washer/dryer combination.

6. The partitioning apparatus of claim 1, wherein the arch sections are made of aluminum.

7. A partitioning apparatus for a washer/dryer combination, comprising:

a cylindrical body having an open top end and an open bottom end;

a plurality of flanges attached to an outer side of the body along a direction of a height of the body wherein each flange extends longitudinally along and outwardly from the body; and a locking means for securing the partitioning apparatus to a drum of the washer/dryer combination, wherein the locking means comprises a plurality of clamps and hooks wherein each clamp is constructed to be clamped to a side of the drum of the washer/dryer combination and each hook is constructed to be hooked to a top of the drum of the washer/dryer combination, wherein the flanges are configured to fit within the drum of the washer/dryer combination, wherein the cylindrical body and the flanges are configured to divide the drum into a cylindrical space and a plurality of arch spaces so that each space is sized to receive garments for washing or drying, and each flange separates the arch spaces from each other.

8. The partitioning apparatus of claim 7, wherein a plurality of holes are formed on the cylindrical body and the flanges.

9. The partitioning apparatus of claim 7, wherein the flange is constructed to correspond to a shape of a baffle of the drum of the washer/dryer combination.

10. The partitioning apparatus of claim 7, wherein there are three flanges.

11. The partitioning apparatus of claim 7, wherein top and bottom rim members are respectively attached to the open top and bottom ends.

12. The partitioning apparatus of claim 11, wherein the open bottom end and the bottom rim member are configured to correspond to a shape of a bottom of the drum of the washer/dryer combination and the bottom rim member is coated with silicon for tight contact with the bottom of the drum of the washer/dryer combination.

13. The partitioning apparatus of claim 7, wherein the cylindrical body is constructed to be fixedly secured to a bottom of the drum of the washer/dryer combination.

14. The partitioning apparatus of claim 7, wherein the cylindrical body is made of aluminum.

15. A partitioning apparatus for a washer or a dryer, comprising:

a cylindrical body having an open top end and an open bottom end;

a plurality of flanges attached to an outer side of the body along a direction of a height of the body wherein each flange extends longitudinally along and outwardly from the body; and a locking means for securing the partitioning apparatus to a drum of the washer or the dryer, wherein the locking means comprises a plurality of clamps and hooks wherein each clamp is constructed to be clamped to a side of the drum of the washer/dryer combination and each hook is constructed to be hooked to a top of the drum of the washer/dryer combination, wherein the flanges are configured to fit within the drum of the washer or the dryer, wherein the cylindrical body and the flanges are configured to divide the drum into a cylindrical space and a plurality of arch spaces so that each space is sized to receive garments for washing or drying, and each flange separates the arch spaces from each other.

16. The partitioning apparatus of claim 15, wherein there are three flanges and a plurality of holes are formed on the cylindrical body and the flanges.

* * * * *